US005275578A

United States Patent [19]

Adams

[11] Patent Number: 5,275,578

[45] Date of Patent: Jan. 4, 1994

[54] CLIP

[76] Inventor: Andy W. Adams, Rte. 3, Box 3384, Hartwell, Ga. 30643

[21] Appl. No.: 639,881

[22] Filed: Jan. 11, 1991

[51] Int. Cl.[5] ..... A63B 5/00

[52] U.S. Cl. ..... 482/27; 606/151; 24/713.6

[58] Field of Search ..... 272/65; 24/713.6, 713.7, 24/713.8, 714.6, 715, 459, 265; AL, 265R; 135/119; 52/3, 4; 182/137, 139; 160/327-329, 399, 402, 405; 606/151, 219-221

[56] References Cited

U.S. PATENT DOCUMENTS

| | | | |
|---|---|---|---|
| 3,378,010 | 4/1968 | Codling et al. | 606/221 |
| 3,948,515 | 4/1976 | McNeil | 272/65 |
| 4,610,250 | 9/1986 | Green | 606/220 |
| 4,958,417 | 9/1990 | Chou | 24/265 R |
| 4,994,073 | 2/1991 | Green | 606/213 X |
| 5,108,422 | 4/1992 | Green et al. | 606/219 |

*Primary Examiner*—Richard J. Apley
*Assistant Examiner*—Glenn E. Richman
*Attorney, Agent, or Firm*—Cort Flint; Henry S. Jaudon

[57] ABSTRACT

A clip for assisting in fastening and stretching of sheet material, such as a cover, a tarpaulin, a tent, a trampoline pad, etc. The clip is constructed to include an upper plate and a lower plate with each plate having a securing hole at one end. When the plates are in their cooperative position, the securing holes are in alignment with each other. A first one of the plates is constructed to have a plurality of pins extending from one surface with a second one of the plates being constructed to have a plurality of cavities arranged therein. The pins and the cavities are arranged in matching patterns so that when the upper and lower plates are pressed together the pins enter the cavities.

22 Claims, 4 Drawing Sheets

CLIP

BACKGROUND OF THE INVENTION

This invention relates to a clip for use with trampolines. The clips are employed to clasp the edge of a trampoline pad and to provide engagement for the springs which secure the pad to a support in a stretched and taught manner. The clips may also be employed for use with covers, tarpaulins, tents, etc. to function in the same manner.

The usual arrangement for trampoline pads is to stitch a plurality of canvas strips in the form of loops about the edges of the pad. The loops engage with the springs in the above described manner and the pad is held taught. The problem with this approach is that the stitching threads have a tendency to deteriorate before the pads do and the loops tear out.

Another approach is to provide metal or plastic eyelets about the edge of the pad. The springs, then engage between the support rail and the eyelets. See U.S. Pat. Nos. 2,991,841 and 3,767,192.

Because of the intense pressure exerted on the pad due to jumping, the eyelets have a tendency to pull out or the small area of pad fabric engaged by the eyelets tears.

An attempt to overcome the above shortcomings is disclosed in U.S. Pat. No. 4,863,156. Here a continuous loop of material is arranged about the trampoline pad. The edge of the pad is looped over and about the loop about the entire periphery. A crimpable fastening means is then crimped over the loop and pad edge about the periphery. The cost of this arrangement is considerably more than the previous arrangements. Also, there is a tendency for the fabric to slip through the clamp due to the intense pressures the pad sustains in use.

Clips, such as taught in U.S. Pat. Nos. 787,719; 1,564,424; and 3,225,408 are old and well known. These clips are not of a sufficiently sturdy construction to function as trampoline clips. None of these clips envision both clamping and penetrating the fabric to ensure positive non-yielding engagement.

It is an object of this invention to provide a clip which overcomes the shortcomings of the prior art as outlined above.

It is a further object of this invention to provide a clip which penetrates the fabric without damage to the fabric construction.

It is a further object of this invention to provide a clip which engages both fabric surfaces of a sufficiently large area and also penetrates the fabric so as to provide horizontal and perpendicular holding action.

It is a further object of this invention to provide an improved trampoline construction through the use of unyielding clips engaging with the pad so that it may be drawn and maintained in a taught condition.

SUMMARY OF THE INVENTION

The above objectives are accomplished according to the invention by a trampoline having a pad with a continuous edge and a plurality of fastening members mounted about the perimeter of the pad in spaced relation. A clip including first and second plates is provided. A first plate has a plurality of substantially perpendicularly disposed pins extending from a face thereof and a securing aperture at one end. The second plate has a plurality of apertures therein arranged to be disposed opposite the pins and securing aperture of the first plate when the plates are superimposed about the edge of the pad which is sandwiched between the plates. The pins of the one plate penetrate through the pad and into the apertures of the second plate.

A plurality of coil springs are provided with each coil spring having a hooked first end and a hooked second end. One end is inserted through the securing apertures to form a mechanical union with the fastening members while the second end of each of the coil springs is hooked to the frame to form a mechanical union so that the pad is resiliently held within the frame.

A clip assists in fastening and stretching of sheet material, such as a cover, a tarpaulin, a tent, a trampoline pad, etc. The clip is constructed to include an upper plate and a lower plate with each plate having a securing hole at one end. When the plates are in their cooperative position, the securing holes are in alignment with each other. A first one of the plates is constructed to have a plurality of pins extending from one surface with a second one of the plates being constructed to have a plurality of cavities arranged therein. The pins and the cavities are arranged in matching patterns so that when the upper and lower plates are pressed together the pins enter the cavities. The plates are configured to have an elongated neck which extends from a bell shaped body.

The securing holes are formed in a head portion of the plates which is constructed to be substantially twice as thick as the remaining area of the clips. The neck of one of the clips has an off-set formed therein so that an upper surface of a head area extends in a different horizontal plane than the upper surface of the remainder of the clip. The neck of the other of the clips has a trough formed therein on a lower surface adjacent its head area. The off-set and the trough are space equidistant from the head area so as to overlay each other when the plates are in cooperating position.

The pins and the cavities are formed on the body area of the plates. These are at least two types of pins, engaging pins and locking pins. The engaging pins are uniformly shaped and function to assist in clamping the pad between the plates. The locking pins, of which there are at least three, have an enlarged, engaging head positioned toward their exterior end to maintain the plates in clamping position while assisting in clamping the pad by positioning the plates in fixed position relative to each other.

The cavities include engaging cavities which are shaped to conform with the longitudinal configuration of the engaging pins and are adapted to receive and support the engaging pins when the plates are in cooperative position. There are also provided locking cavities which have engaging lips formed therein which cooperate with the engaging head of the locking pins to lock the plates in a fixed cooperative position. The locking cavities are non-circular in configuration and have lips which extend transverse to the longitudinal surfaces of the locking cavities.

Normally, the cavities are formed solely in one of the plates and the pins are formed solely on the other of the plates. The cavities extend entirely through the plate. Normally, the plate with the cavities includes a plurality of longitudinally extending ribs.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
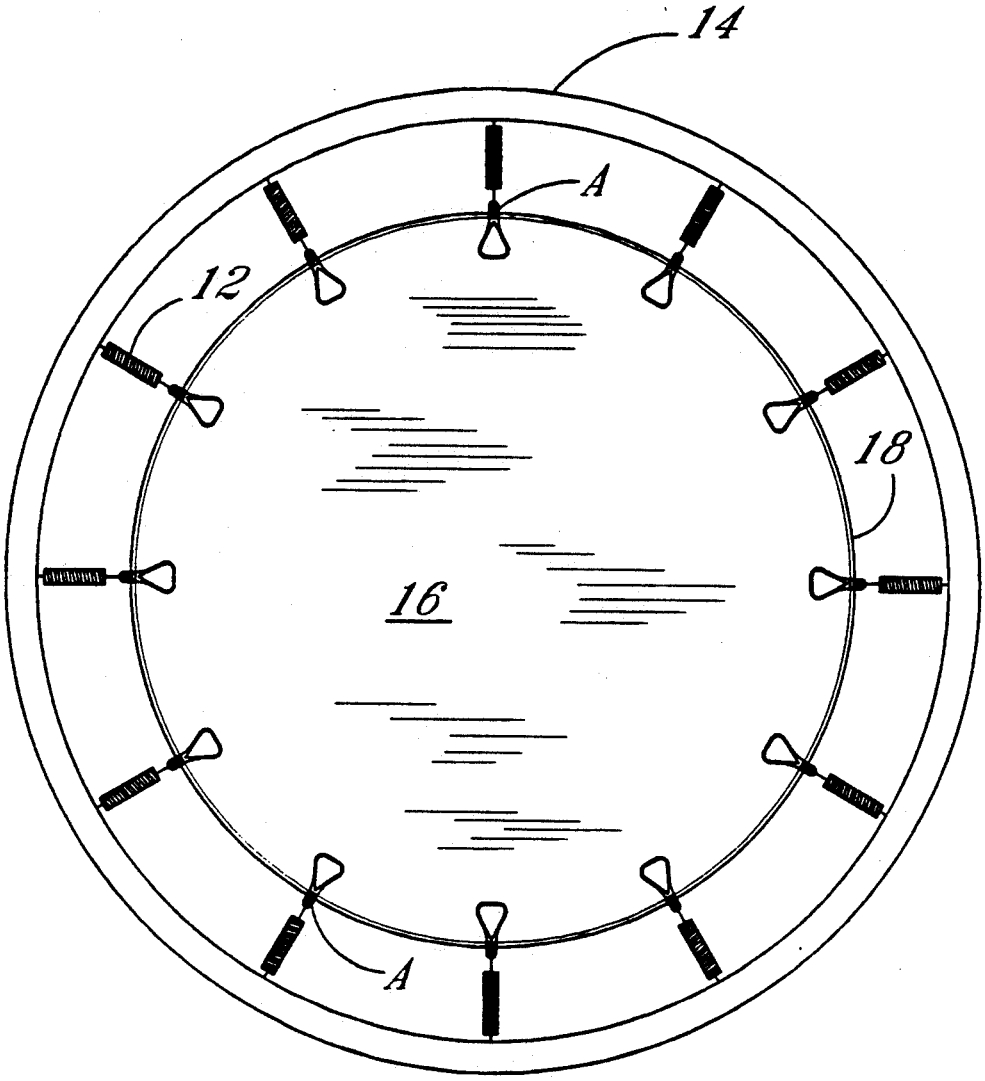
FIG. 1 is a top view of a trampoline utilizing the clip of the invention.
Figure 2:
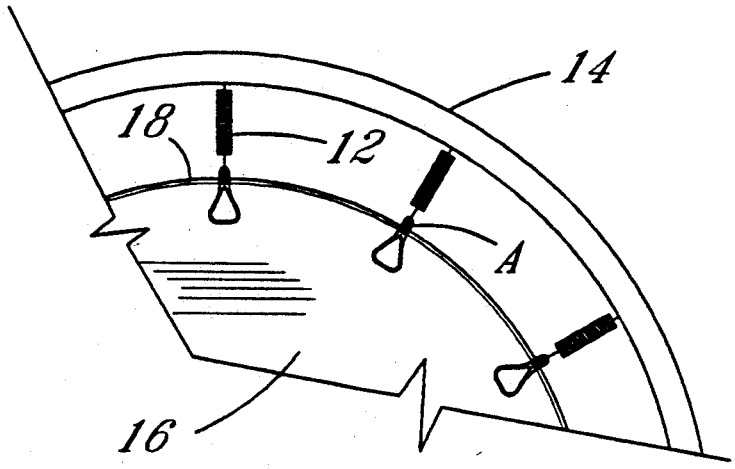
FIG. 2 is an enlarged top section of FIG. 1.

The present invention as best seen in FIGS. 1 and 2 is directed to a clip A which is intended to be arranged about and fastened to the exterior edge of a trampoline pad. Clips A are provided with securing holes 10 at one end which engage with springs 12. Springs 12 are then engaged with support ring 14 so that trampoline pad 16 is stretched taught and held in its operative position.

Clip A is by no means intended to be restricted to use with trampolines but may find application for use with various types of covers, tarpaulins and tents.

Normally, trampoline pads 16 are formed of carbon coated, multi-filament polypropylene yarns of between 200 and 1000 denier. Other synthetic yarns which possess adequate strength and wear characteristics are equally acceptable. Pads 16 are normally woven in a plane weave of between forty and sixty picks and ends per inch. There are also other weave patterns which are suitable. The pads are finished with a hot knife which cuts the fabric to shape and at the same time seals and finishes the cut edge 18. This is achieved because the heated blade causes the thermoplastic yarns to melt at the cutting point and become adhered to adjacent cut ends. This is a common procedure forming no part of the present invention. It is also possible to provide a stitched finished edge.

Clamp A must have the capability of being secured about edge 18 of pad 16 in a permanent or non-slipping position. Should the clip slip, this will result in damage to edge 18 and the portion of the pad adjacent to the edge. Also, should the clip slip, pad 15 will no longer be held taught which adversely affects the operativeness of the trampoline.

It has been found that polypropylene or an injected grade of thermo-plastics are the most desirable materials for forming clip A. There are many other materials and plastics which are acceptable and the invention is in no way intended to be limited to a particular plastic. It is desirable that the plastic forming the clip have a tensile strength of between 400 and 5000 psi when measured according with ASTM standard.

Figure 3:
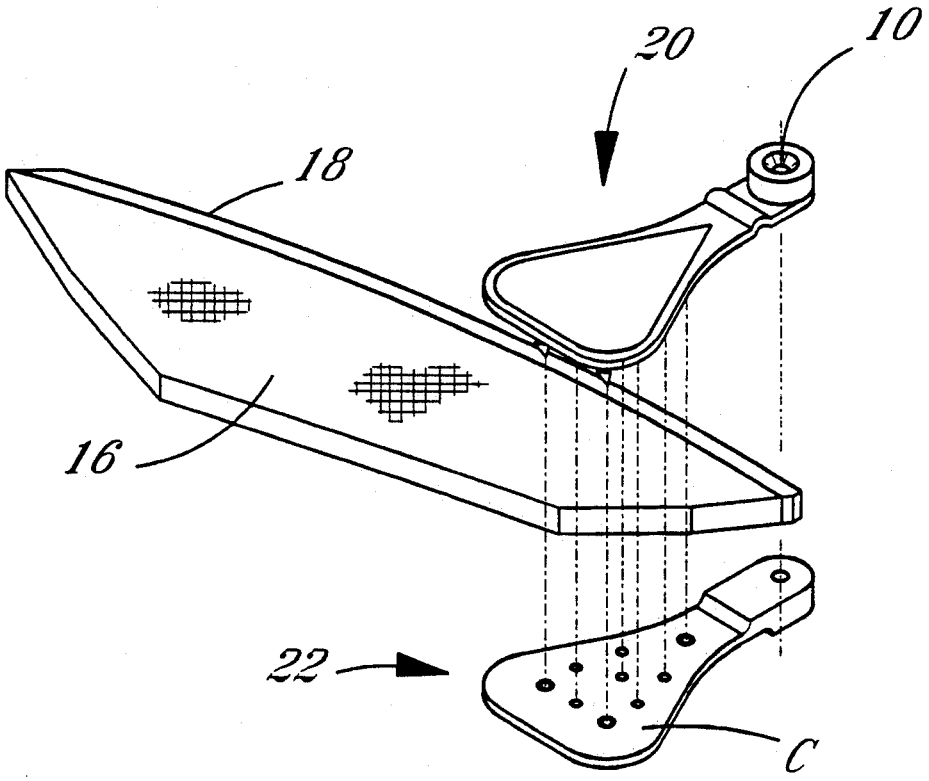
FIG. 3 is an exploded perspective view showing the clip and the pad in operative relationship.
Figure 4A:
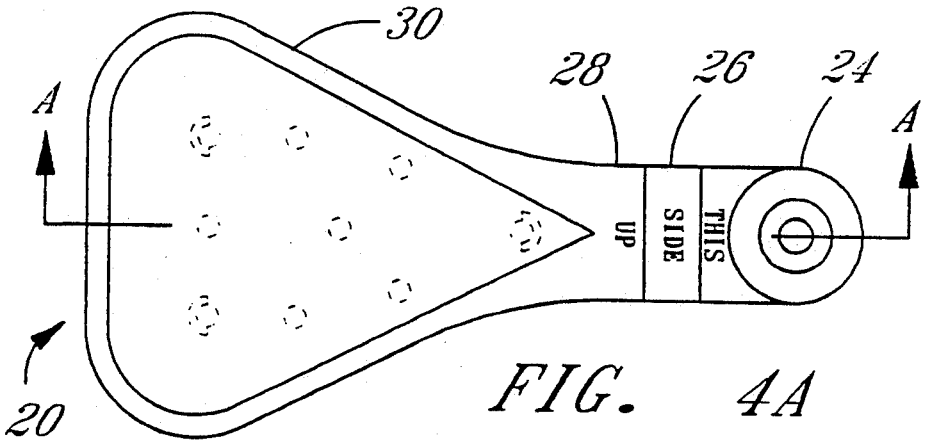
FIGS. 4 and 5 are exploded top and side sectional views of the clip.
Figure 4B:
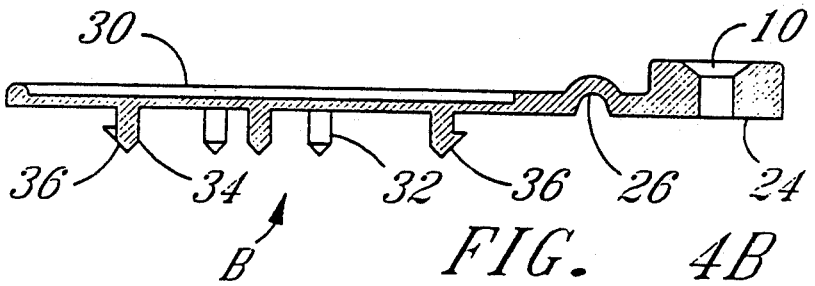
Figure 5B:
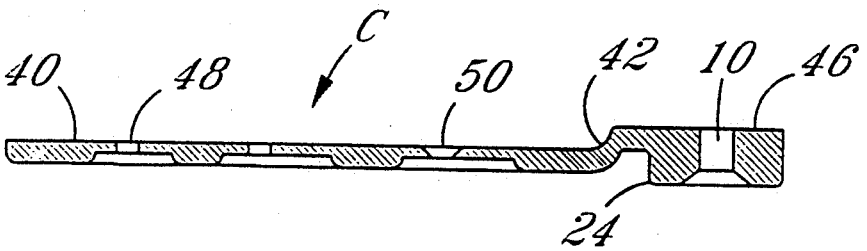
Figure 5A:
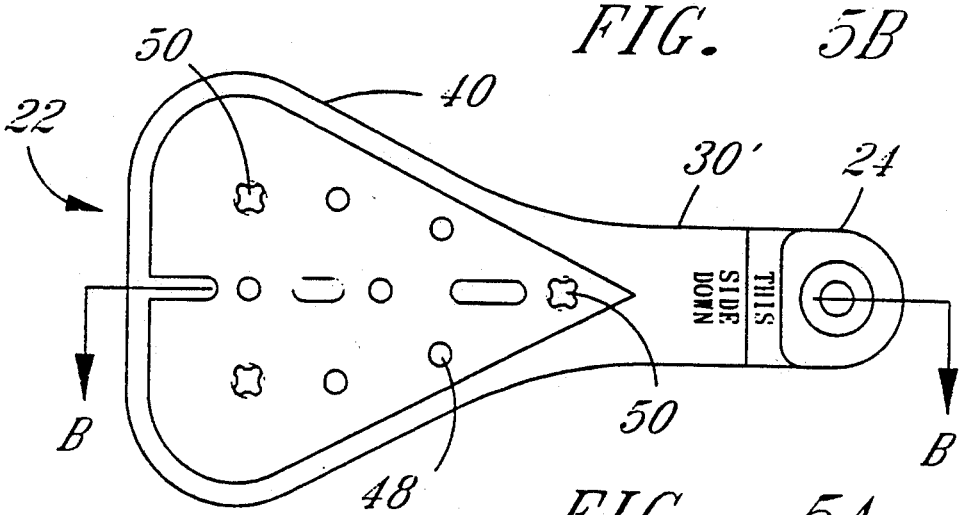

Clip A is formed of upper plate 20 and lower plate 22 as seen in FIG. 3-5. The plates are configured in substantial mirror image, each having a head portion 24, neck portions 28, 30' and a body portion 30, 40. Plates 20, 22 are generally pear or beaker shaped, are approximately 11 cm in length, 6 cm at the widest body point, and have a neck to include a head of approximately 5 cm. Plates 20, 22 are approximately 3 mm thick except at head portion 24 which is approximately 6 mm thick. Again, these measurements are only what is considered to be most desirable. It is envisioned that modifications in size are within the scope of this invention.

Upper plate 20 consists of head 24 which merges with neck 28 which in turn merges with body 30 which is generally a bell shaped cross-section. Head 24 has securing hole 10 passing through its approximate center. In the vicinity of the merger point of neck 28 and head 24, there is formed a trough 26 which extends transverse of the neck. Trough 26, which is located in face B, is approximately 1 mm deep and is located approximately 2½ cm from the head end of clip 20.

Face B, in body area 30 has formed thereon a plurality of engaging pins 32 and locking pins 34 which are arranged in a pattern as shown.

Figure 6A:
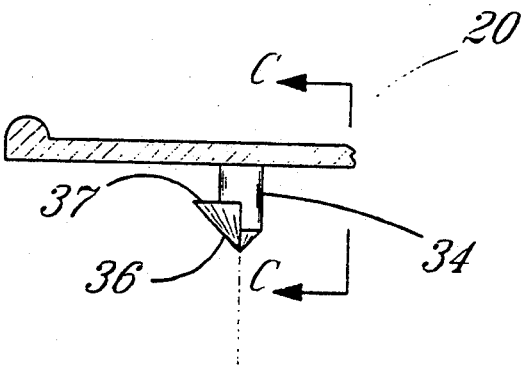
FIG. 6 is an exploded section of the locking projection.
Figure 6B:
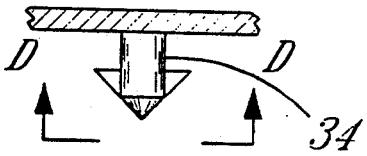
Figure 6C:
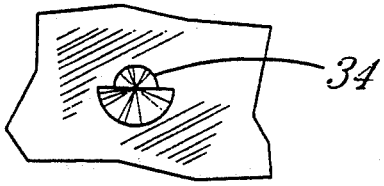

Engaging pins 32 have a circular and uniformly contained body of approximately 3 mm in diameter and 6 mm in length. Engaging pins 32 terminate with a pointed end. Pins 34, designated locking pins, are of substantially equal length and diameter as engaging pins 32. Each pin 32 has a locking head 36 arranged at its terminating end. Locking head 36 consists of a lip which extends outwardly from approximately half of the circumference of pin 36 adjacent to its terminating end. See FIGS. 4 and 6. The locking heads extend outwardly away from the center of the clip.

Figure 7A:
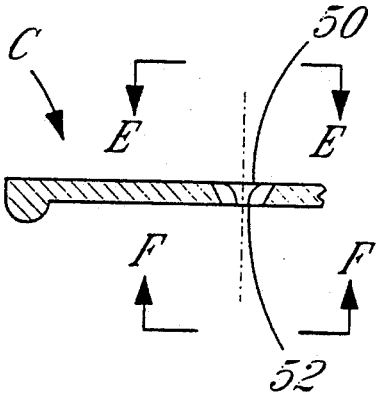
FIG. 7 is an exploded section of the locking cavity.
Figure 7B:
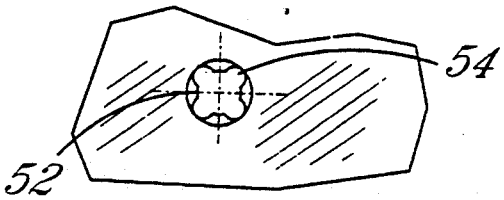
Figure 7C:
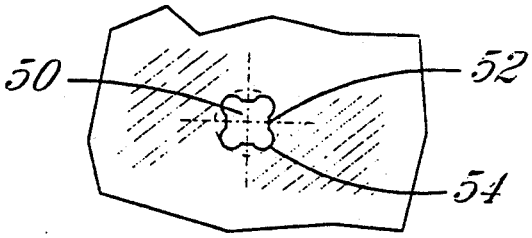

Lower plate 22 consists of head 24 which has also a securing hole 10 formed therein. Head 24 merges with neck 30' which merges with body portion 40. An off-set 42 is formed in neck 30' at a point corresponding with the location of trough 26 in plate 20. Off-set 42 off-sets slightly the plane of face C relative to the lower face 46 of head 24. Face C has a plurality of engaging cavities 48 and locking cavities 50 arranged in a pattern corresponding with the pattern of pins 32 and 34. Engaging cavities 48 are sized to receive engaging pins 32 with a firm fit. Locking cavities 50 are counter sunk from face C resulting in a funnel shaped upper opening and a relatively square shaped lower opening, see FIG. 7. The lower opening has four corner or cavity areas 54 formed therein. Approximately midway the length of cavities 50 and extending between adjacent cavities are formed four flexible locking lips 52. Lips 52 extend along a convex path between corner areas 54 and are located slightly inward of surface C. This configuration allows the enlarged locking head 36 to pass through the funnel shaped opening of cavity 50, flex and move past lips 52 and engage lower surface 37 with the outer surface of plate 22.

In use, faces B and C of plates 20, 22 are arranged in facing relationship. Pins 32, 34, cavities 48, 50 and holes 10 are arranged in overlaying relationship. The edge 18 of pad 16 is placed between faces B and C of plates 20, 22 with its outer periphery in alignment with trough 26 and off-set 42. Pins 32, 34 are pressed through pad 16 as plates 20, 22 are moved toward each other. Pins 32, 34 enter cavities 48, 50 with locking pins 32 passing through locking cavities 50 so that surface 37 engages the outer surface of plate 22 and secures the plates in position.

Pins 32, 34 do not tear or break the yarns forming pad 16 but slightly shift the yarns as they pass through. This is due to the density of the weave, the composition of the yarns and the size of the pins.

Clip A, when in operative position exerts longitudinal pressure on the pad 16 along faces B and C which tends to also hold the yarns in position. At the same time, pins 32,34 apply a transverse holding action against movement of the pad.

While a preferred embodiment of the invention has been described using specific terms, such description is for illustrative purposes only, and it is to be understood that changes and variations may be made without departing from the spirit or scope of the following claims. For example, the pins and cavities could be interchanged between plates. Also, the pins and cavities need not necessarily be arranged perpendicularly to the plane of the plates. There is no reason that all pins could not be locking pins nor is it necessary that the pins have a circular shank. The clip could be designed with only one head and securing hole.

What is claimed is:

1. A trampoline comprising:

a pad having a continuous edge forming the perimeter of said pad;

a plurality of fastening members mounted about said perimeter of said pad in spaced relation, each said fastening member including:

an elongated first plate having a plurality of substantially perpendicularly disposed pins formed integral with and extending from a face thereof, said first plate including a second aperture at one end thereof;

an elongate second plate having a plurality of apertures formed therein and arranged to align with said pins of said first plate so that when said plates are superimposed with the edge of said pad sandwiched between said plates, said pins of said first plate penetrate through said pad and into said apertures of said second plate and secure the edge of said pad between said plates;

a plurality of coil springs, each coil spring having a hooked first end and a hooked second end; said first end being inserted through said securing aperture forming a mechanical union between the springs and said fastening members;

a frame, said second end of each said coil spring being hooked to said frame to form a mechanical union whereby said pad is resiliently and taughtly held within said frame.

2. The fastening member of claim 1 wherein means are provided to lock said plates together to form said fastening members.

3. The fastening member of claim 2 wherein said locking means comprises pins with enlarged heads which act with flexible flanges of certain apertures to lock said plates together.

4. A clip for assisting in fastening and stretching of sheet material, such as a cover, a tarpaulin, a tent, a trampoline pad, etc., said clip comprising:

an upper plate and a lower plate, each plate having a securing hole at one end which, when the plates are in cooperative position, are in alignment with each other;

a first of said plates constructed to have a plurality of pins formed integral therewith to extend from one surface thereof;

a second of said plates constructed to have a plurality of cavities formed therein;

said pins and said cavities are arranged in matching patterns so that said upper and lower plates may be positioned with said securing holes, said pins and said cavities aligned; whereby, said plates are pressed together so that said pins enter said cavities to secure said plates to form said clip.

5. The clip of claim 4 wherein said plates are configured to have an elongated neck which extends from a bell shaped body and includes a securing hole formed in a head area thereof.

6. The clip of claim 5 wherein said head portion of said plates is constructed to be substantially twice as thick as the remaining area of said clips.

7. The clip of claim 5 wherein the neck of one of said clips has an off-set formed therein so that a upper surface of a head area extends in a different horizontal plane than the upper surface of the remainder of said clip.

8. The clip of claim 7 wherein the neck of one of said clips has a trough formed therein adjacent said head area.

9. The clip of claim 8 wherein said off-set and said trough are spaced equidistant from said head area.

10. A clip for assisting in stretching and fastening sheet material such as a cover, a terrapin, a tent, a trampoline pad, etc., in a substantially taught fixed position, said clip comprising;

an elongate upper plate composed of a neck portion and a body portion of greater width that said neck portion;

an elongate lower plate composed of a neck portion and a body portion of greater width than said neck portion;

said upper plate and said lower plate having peripheries which over lie each other when said upper and lower plates are arranged in cooperating relationship;

a securing hole adapted to receive securing means formed in said neck portion of said upper plate and said lower plate;

a plurality of pins arranged in a first pattern and formed to extend from a first surface of said body portion of said upper plate;

a plurality of cavities arranged in said first pattern and formed in a surface of said body portion of said lower plate; whereby said clip functions as a unitary member to secure with said sheet material by overlying at least a portion of said upper and lower plates with a portion of said sheet material extending over said first surfaces of said body portion of said upper and lower plates, causing said pins to penetrate said sheet material and secure with said cavities and aligning said securing holes to form a single opening through said neck portions for reception of said securing means.

11. The clip of claim 10 wherein said pins extend from and said cavities are formed in said body portion.

12. The clip of claim 5 wherein said pins comprise at least engaging pins and locking pins.

13. The clip of claim 12 wherein said engaging pins are uniformly shaped and function to assist in clamping and holding the sheet material between said upper and lower plates.

14. The clip of claim 12 wherein said locking pins have an enlarged engaging head positioned formed adjacent an exterior end of said locking pins, said head functioning to maintain said plates in clamping position while assisting in clamping and holding said sheet material between said upper and lower plates.

15. The clip of claim 14 wherein there are at least three locking pins and at least six engaging pins.

16. The clip of claim 13 wherein said cavities include engaging cavities which are shaped to conform with the longitudinal configuration of said engaging pins and are adapted to receive and support said engaging pins when said plates are in cooperative position.

17. The clip of claim 14 wherein said cavities include locking cavities, said locking cavities having engaging lips formed therein which cooperate with said engaging head of said locking pins to lock said plates in cooperative position.

18. The clip of claim 17 wherein said locking cavities are non-circular in configuration and said lips extend transverse of longitudinal surfaces of said cavities.

19. The clip of claim 10 wherein said clip is formed of plastic material.

20. The clip of claim 10 wherein said cavities are formed solely in one of said upper and lower plates and said pins are formed solely on the other of said upper and lower plates.

21. The clip of claim 20 wherein said cavities extend entirely through said one plate.

22. The clip of claim 21 wherein said one plate includes a plurality of longitudinally extending ribs.

* * * * *